US005415986A

United States Patent [19]

Fujita et al.

[11] Patent Number: 5,415,986

[45] **Date of Patent: * May 16, 1995**

[54] SILVER HALIDE PHOTOGRAPHIC LIGHT SENSITIVE MATERIAL

[75] Inventors: Akio Fujita; Takeo Arai, both of Hino, Japan

[73] Assignee: Konica Corporation, Japan

[ * ] Notice: The portion of the term of this patent subsequent to Jul. 19, 2011 has been disclaimed.

[21] Appl. No.: 50,540

[22] Filed: Apr. 20, 1993

[30] Foreign Application Priority Data

Apr. 22, 1992 [JP] Japan ..... 4-102998

[51] Int. Cl.[6] ..... G03C 1/38; G03C 1/76

[52] U.S. Cl. ..... 430/523; 430/527; 430/537; 430/600; 430/613; 430/611; 430/603; 430/631

[58] Field of Search ..... 430/523, 537, 613, 631, 430/527, 603, 611, 600

[56] References Cited

U.S. PATENT DOCUMENTS

| | | | |
|---|---|---|---|
| 4,822,727 | 4/1989 | Ishigaki et al. | 430/523 |
| 4,847,186 | 7/1989 | Mukunoki et al. | 430/523 |
| 4,849,324 | 7/1989 | Aida et al. | 430/611 |
| 4,943,520 | 7/1990 | Yoneyama et al. | 430/523 |

*Primary Examiner*—Thorl Chea

*Attorney, Agent, or Firm*—Jordan B. Bierman; Bierman and Muserlian

[57] ABSTRACT

A silver halide photographic light sensitive material comprising a support bearing thereon at least one silver halide emulsion layer and a backing layer on the back side of the support, wherein; the backing layer contains a compound represented by Formulas [1] or [2]; at least one of the hydrophilic colloidal layers including the silver halide emulsion layer contains a polymer latex stabilized with gelatin; and the outermost layer on the side of the layers including the silver halide emulsion layer or the outermost layer on the opposite side of the layers thereof contain a fluorine-containing anionic or cationic surfactant(s).

Formula [1]

Formula [2]

6 Claims, No Drawings

SILVER HALIDE PHOTOGRAPHIC LIGHT SENSITIVE MATERIAL

FIELD OF THE INVENTION

This invention relates to a silver halide photographic light sensitive material and, particularly, to a high contrast silver halide photographic light sensitive material excellent in characteristics in continuous processing.

BACKGROUND OF THE INVENTION

In the field of photographic plate-making processes in which silver halide photographic light sensitive materials are used, there have been used the processes for making original printing blocks in such a manner that a photographic image having continuous gradation is converted into a so-called half-tone dotted image formed of the various sizes of half-tone dots and the resulting half-tone dotted image is used in combination with an already photographed letter or line original so that an original printing block can be prepared.

As for the silver halide photographic light sensitive materials applicable to the above-mentioned purpose, it has been required to use those having a high contrast and a high photographic density each capable of clearly discriminating between an imaged area and a non-imaged area, that is, those capable of showing ultra-high contrast photographic characteristics, so that a half-tone dotted image or the reproduction of letters or lines can be made excellent.

The methods for obtaining the above-mentioned characteristics include, for example, the methods in which a tetrazolium salt is used, such as those described in Japanese Patent Open to Public Inspection (hereinafter abbreviated to JP OPI Publication) Nos. 52-18317/1977, 53-95618/1978, 58-173737/1983 and 58-106943/1983; and the methods in which a hydrazine derivative is used, such as those described in U.S. Pat. Nos. 4,166,742, 4,168,977, 1,211,857, 4,224,401, 4,243,739, 4,272,606 and 4,311,781.

The developers used therein can be said to be suitable for developing light sensitive materials continuously while constantly replenishing them into an automatic processor, (the developing process is so-called a running process.), because these developers may not be more affected by an air oxidation, as compared to any conventional lith type developers.

In the above-mentioned running process, the improvements of light sensitive materials, processing solutions and replenishing methods have variously been made so that a stability can be realized by replenishing as small as possible. However, the techniques such as the above-mentioned still remain not satisfactory, but defective because of lowering a contrast and varying a sensitivity.

For stabilizing a running process carried out when making combination use of two or more kinds of plate-making materials, there are known techniques in which an inorganic halide, an alkylene oxide compound or a nitrogen-containing heterocyclic compound is contained in a backing layer or in an other layer of the light sensitive material, (refer to those described in JP OPI Publication No. 52-80024/1977 and so forth). However, these techniques are still not satisfactory in stabilizing the running process for a high-contrast light sensitive material containing a tetrazolium salt or a hydrazine derivative, particularly, in a small amount replenishing running-process. On the other hand, Example 1 given in JP OPI Publication No. 52-80024/1977 describes that polyethylene glycol is added to a backing layer. This particular case is quite different from this present invention in a running process, because in this case, at least two kinds of plate-making materials are used in combination, wherein a compound to be contained in a silver halide light sensitive material is contained in a backing layer of another light sensitive material.

In recent years, the drainage control regulations are getting severe particularly in urban communities, because of environmental protection problems.

Therefore, developing and fixing solutions wasted when processing light sensitive materials cannot be flowed into sewers, but generally collected by recyclers upon paying the collection expenses to them from individual users. The collection expenses are proportional to the amounts of the subject wasted solutions. When the amount of wasted solutions is smaller, it is more beneficial for the users and it can also easily be supposed to be preferable above all when taking the environmental problems into consideration.

Reduction of a wasted amount is to be that a replenishing amount is to further be reduced. Therefore, many problems may arise therefrom.

The first problem is that, when carrying out a running process, a sensitivity is further lowered than in ordinary running processes.

The second problems may sometimes arise when the concentration of the components dissolved out of a light sensitive material is increased in a developer and the compounds having a relatively low solubility among the dissolved-out compounds may be deposited in the developer.

The resulting deposited substances are present in the form of oil drops. They are deposited on the surfaces of the transport rollers of an automatic processor used and they are liable to adhere thereto as they are. Therefore, the deposits resultingly adhere to the surface of the processed light sensitive material.

The adhering matter is in the form of oil (that is so called oil sludge.) and it causes a partial development abnormality, because it hinders the permeation of a developer or fixer. If this is the case as it is, an image is seriously spoiled so that the resulting image cannot be worth using.

It has, therefore, been demanded to improve the above-described deterioration in light sensitive materials as soon as possible.

SUMMARY OF THE INVENTION

It is, accordingly, an object of the invention to provide a silver halide photographic light sensitive material having high contrast, being less in the deteriorations of sensitivity and contrast even when carrying out a running process with a low replenishing rate, and excellent in the prevention from oil-sludges produced in a low replenishment and image stains produced thereby.

The above-mentioned objects of the invention can be achieved with a silver halide photographic light sensitive material comprising a support bearing at least one silver halide emulsion layer thereon and a backing layer on the back side of the support; wherein the backing layer contains Compound 1 represented by Formula [1] and/or Compound 2 represented by Formula [2]; at least one of the hydrophilic colloidal layers including the silver halide emulsion layer contains a polymer latex stabilized with gelatin; and the outermost layer of the layers including the light-sensitive silver halide emulsion layer and/or the outermost layer on the opposite side thereto contain a fluorine-containing anionic surfactant Compound 3 represented by Formula [FA] and/or a fluorine-containing cationic surfactant Compound 4 represented by Formula [FK].

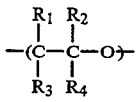

Formula [1]

wherein $R_1$ through $R_4$ each represent a hydrogen atom, a halogen atom, a carbonyl or sulfo group, an alkyl, aryl, alkenyl or alkoxy group, each of which may be substituted,

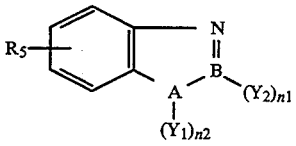

Formula [2]

wherein $Y_1$ and $Y_2$ each represent a hydrogen atom, a mercapto group; $R_5$ represents a hydrogen atom, a halogen atom, an alkyl, alkenyl, alkynyl, aryl or alkoxy group, eah of which may be substituted, a nitro group, an amino group, a cyano group, a hydroxycarbonyl group, an alkoxycarbonyl group, an alkylcarbonyl group, a hydroxy group, a mercapto group or a sulfo group; A represents a carbon, nitrogen or oxygen atom, provided that when A represents a carbon atom, $n_2$ is 2, when A represents a nitrogen atom, $n_2$ is 1; and when A represents a oxygen atom, $n_2$ is 0, B represents a nitrogen or carbon atom, provided that when B represents a carbon atom, $n_1$ is 1; and when B represents a nitrogen atom, $n_1$ is 0, $$Rf\text{-}(A)_n\text{-}Y$$

Formula [FA]

wherein $R_f$ represents a fluorine-substituted alkyl or aryl group having 3 to 30 carbon atoms; A represents a bivalent linking group having 1 to 12 carbon atoms and a linking group selected from —O—, —COO—, —CO-N—$R_1$, and —$SO_2$N—$R_1$, in which $R_1$ represents an alkyl group having 1 to 5 carbon atoms; n is 1 or 2, and Y represents —COOM, —$SO_3$M, —$OSO_3$M or

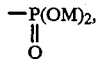

in which M represents an alkali metal atom, an alkaline earth metal atom or an a quaternary ammonium group, $$(Df)\text{-}(W)_n$$

Formula [FK]

wherein $D_f$ a n-valent group containing at least three fluorine atoms and at least three carbon atoms; W represents

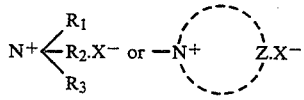

wherein $R_1$ through $R_3$ represents a substituted or unsubstituted alkyl group having 1 to 4 carbon atoms; X represents an halogen atom or a R—$SO_2$—$O^-$ group, in which R represents an alkyl having 1 to 10 carbon atoms or aryl group; Z is an atomic group necessary to form a 5- or 6-membered ring; and n is 1 or 2.

It is a preferable embodiment of the invention that, when processing the above-mentioned light sensitive material, the developer is replenished in an amount of not more than 300 ml/$m^2$ and the fixer is replenished in an amount of not more than 450 ml/$m^2$.

DETAILED DESCRIPTION OF THE INVENTION

Now, the invention will be detailed below.

The typical examples of the compounds represented by Formula [1] will be given below. However, this invention shall not be limited thereto.

| | | |
|---|---|---|
| $HO(CH_2CH_2O)_nH$ | [n = 28] | 1-1 |
| $HO(CH_2CH_2O)_nH$ | [n = 35] | 1-2 |
| $HO(CH_2CH_2O)_nH$ | [n = 68] | 1-3 |
| ${}_nC_4H_9O(CH_2CH_2O)_nH$ | [n = 20] | 1-4 |
| $HO(CH(C_2H_5)CH(C_2H_5)O)_nH$ | [n = 35 ] | 1-5 |
| $HO(CH(Cl)CH_2O)_nH$ | [n = 22] | 1-6 |
| $HO(CH(COOH)CH_2O)_nH$ | [n = 36] | 1-7 |
| $HO(CH(SO_3H)CH_2O)_nH$ | [n = 36] | 1-8 |
| ${}_nC_{12}H_{25}O(CH_2CH_2O)_nH$ | [n = 40] | 1-9 |

-continued 1-10

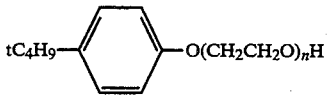

[n = 40]

1-11

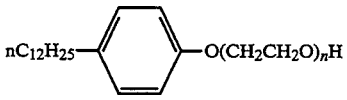

[n = 30]

1-12

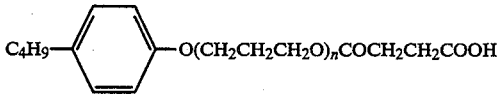

[n = 50]

1-13

$HO(CH_2-CH_2-O)_l(CH_2)_m(CH_2-CH_2-O)_nCOCH_2CH_2COOH$

[l + n = 50, m = 5]

1-14

$HO(CH_2-CH(CH_2CH_2OH)-O)_l(CH(CH_3)CH_2-O)_m(CH_2CH(CH_2CH_2OH)O)_nH$

[l + n = 30, m = 35]

1-15

$HO(CH_2CH_2O)_l(CH_2CH(CH_3)O)_m(CH_2CH_2O)_nH$

[l + n = 18, m = 20]

1-16

$HO-(CH_2CH_2O)_l-(CH_2CH(CHO_2OC_2H_5)O)_m-CH_2CH(CH_3)O-(CH_2CH(CH_2OC_2H_5)O)_n-(CH_2CH_2O)_o-H$

[l + o = 20, m +n = 12]

1-17

$HO-(CH_2CH_2O)_l-(CH_2CH(CHO_2OC_2H_5)O)_m-CH_2CH(CH_3)O-(CH_2CH(CH_2OC_2H_5)O)_n-(CH_2CH_2O)_o-H$

[l + o = 17, m + n = 10]

1-18

$HO(CH(COOH)-CH_2O)_l(CH_2CH(CH_3)O)_m(CH(COOH)-CH_2O)_nH$

[l + n = 25, m = 20]

1-19

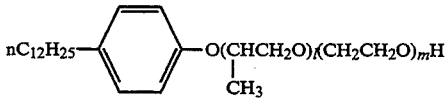

[l = 7, m = 30]

1-20

$HOOCCH_2CH_2C(=O)O(CH_2CH_2O)_l(CH_2CH_2CH_2CH_2O)_m(CH_2CH_2O)_nC(=O)CH_2CH_2COOH$

[l + n = 15, m = 15]

1-21

$HOOCCH_2CH_2CO(CH_2CH_2O)_l(CH(CH_3)CH_2O)_m(CH_2CH_2O)C(=O)CH_2CH_2COOH$

[l + n = 15, m = 20]

1-22

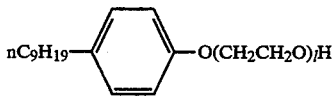

[l = 30]

1-23

$HO(CH_2CH_2O)_l(CH(CH_2CH_2O)_nH)(CH_2CH_2CH_2CH_2O)_m$

[l + n = 23, m = 21]

-continued $$HO(CH_2CH_2O)_l(\underset{\underset{(CH_2CH_2O)_nH}{|}}{CH_2CH_2CH_2CH_2O})_m$$ 1-24

[l + n = 38, m = 15]

$$HO(CH_2CH_2O)_l(\underset{\underset{CH_2OCH_3}{|}}{CHCH_2O})_m(CH_2CH_2O)_nH$$ 1-25

[l + n = 15, m = 15]

$$HO(CH_2CH_2O)_l(\underset{\underset{CH_2OCH_3}{|}}{CHCH_2O})_m(CH_2CH_2O)_nH$$ 1-26

[l + n = 30, m = 15]

$$_nC_{12}H_{25}O(\underset{\underset{CH_3}{|}}{CHCH_2O})_l(CH_2CH_2O)_mH$$ 1-27

[l = 7, m = 30]

$$HO(CH_2CH_2O)_l(CH_2\overset{\overset{CH_3}{|}}{C}HO)_m(CH_2CH_2O)_nH$$ 1-28

[l +n = 25, n = 20]

$$HO(CH_2CH_2O)_l(CH_2\overset{\overset{CH_3}{|}}{C}HO)_m(CH_2CH_2O)_nH$$ 1-29

[l + n = 25, n = 30]

The typical examples of the compounds represented by the afore-given Formula [2] will be given below. However, this invention shall not be limited thereto.

| Exemplified compounds | |
|---|---|
| 2-1 | Benzotriazole |
| 2-2 | 5-methylbenzotriazole |
| 2-3 | 5-chlorobenzotriazole |
| 2-4 | 5-nitrobenzotriazole |
| 2-5 | 5-ethylbenzotriazole |
| 2-6 | Hydroxycarbonylbenzotriazole |
| 2-7 | 5-hydroxybenzotriazole |
| 2-8 | 5-aminobenzotriazole |
| 2-9 | 5-sulfonebenzotriazole |
| 2-10 | 5-cyanobenzotriazole |
| 2-11 | 5-methoxybenzotriazole |
| 2-12 | 5-ethoxybenzotriazole |
| 2-13 | 5-mercaptobenzotriazole |
| 2-14 | Benzimidazole |
| 2-15 | 5-sulfonebenzimidazole |
| 2-16 | 5-methoxybenzimidazole |
| 2-17 | 5-chlorobenzimidazole |
| 2-18 | 5-nitroindazole |
| 2-19 | 6-nitroindazole |
| 2-20 | 5-sulfoindazole |
| 2-21 | Benzoxazole |
| 2-22 | 2-mercapto-5-sulfobenzimidazole |
| 2-23 | 2-mercaptobenzoxazole |

The compounds represented by Formulas [1] and [2] applicable to the invention can be contained in the backing layer of at least one of a plurality of light sensitive materials to be processed with one and the same developer. The amounts of these compounds to be used cannot be determined unconditionally, but depend upon an amount of silver halide used, an amount of the compounds represented by Formulas [1] and [2], a method of coating the backing layer, an amount of a developer replenished and so forth. It is, therefore, preferable to use these compounds at a suitable time and in a suitable amounts. Generally, each of these compounds may be used in an amount within the range of, preferably, 0.1 mg to 1 g and, more preferably, 1 mg to 100 mg, each per sq.meter of a silver halide light sensitive material to be processed.

The polymer latexes stabilized with gelatin, which are applicable to the invention, are characterised in that the surfaces and/or inside thereof is dispersedly stabilized with gelatin. It is particularly preferable that the gelatin is bonded to the polymer constituting a latex to improve dispersion stability. When this is the case, the gelatin may be bonded either directly or through a cross-linking agent to the polymer.

The polymer latexes stabilized with gelatin of the present invention can be prepared in a manner that the polymerization reaction of the polymer latex is completed and then a gelatin solution is then added so as to react with the polymer. It is preferable that the polymer latex synthesized in a surfactant-containing solution and gelatin are reacted by making use of a cross-linking agent. Further, they can also be prepared in the method of making gelatin present in the course of the polymerization reaction. The latter method can have a more preferable results than in the former method. In this case, it is preferable that no surfactant is to be used in the course of the polymerization reaction. When making use of a surfactant, it may be added in an amount within the range of, preferably, 0.1 to 3.0% and, more preferably, 0.1 to 1.5% of the polymer components.

When synthesizing polymer in the presence of gelatin, the ratio of the gelatin to the polymer is within the range of, preferably, 1:100 to 2:1 and, more preferably, 1:50 to 1:2, most preferably 1:20 to 1:4.

Of the polymer latexes stabilized with gelatin, which are applicable to the invention, the average particle size thereof is to be within the range of, preferably, 0.005 to 1 μm and, more preferably, 0.02 to 0.5 μm.

The polymer latexes stabilized with gelatin include the hydrates such as acrylic acid esters, methacrylic acid esters and styrene, as given in, for example, U.S. Pat. Nos. 2,772,166, 3,325,286, 3,411,911, 3,311,912 and 3,525,620 and Research Disclosure No. 195 19551 (July, 1980).

In the polymer latexes stabilized with gelatin, which are preferably applicable to the invention, the polymer components thereof include, for example; homopolymers of alkyl methacrylate such as methyl methacrylate and ethyl methacrylate; homopolymers of styrene; copolymers of alkyl methacrylate or styrene and acrylic acid, N-methylol acrylamide or glycidol methacrylate; copolymers of alkyl acrylate and acrylic acid or N-methylol acrylamide (of which the copolymer component such as acrylic acid is preferably up to 30 wt %); homopolymers of butadiene; copolymers of butadiene and either one of or a combination of styrene, butoxymethyl acrylamide and acrylic acid; and a terpolymer of vinylidene chloride, methyl acrylate and acrylic acid.

When bonding such a polymer latex as given above to gelatin through a cross-linking agent, it is preferable that the monomers constituting the polymer latex are to contain a reactive group including, for example, a carboxyl group, an amino group, an amido group, an epoxy group, a hydroxyl group, an aldehyde group, an oxazoline group, an ether group, an active ester group, a methylol group, a cyano group, an acetyl group and an unsaturated carbon bondage. Further, when making use of a cross-linking agent, those usually applicable to gelatin may also be used, such as those of the aldehyde type, the glycol type, the triazine type, the epoxy type, the vinylsulfone type, the oxazoline type, the methacryl type and the acryl type. Still further for increasing the dispersion stability of the polymer latex stabilized with gelatin, 2-acrylamido-2-methylpropane sulfonic acid or the salts thereof may also be used as the monomer constituting a polymer latex. When the above-mentioned monomer is added in an amount within the range of 0.5 to 20 wt % of the whole weight of the constituting components, a preferable result may be obtained.

As for the gelatin applicable to stabilize the latexes of the invention, gelatin, a gelatin derivative, a cellulose derivative and a graft polymer of gelatin and other macromolecular substances; and, besides, they are also allowed to be used in combination with a hydrophilic colloid such as protein, a sugar derivative, a cellulose derivative and a monomer or copolymer of synthetic hydrophilic macromolecular substances.

As for the gelatin, acid-treated gelatin such as those described in Bulletin of Society of Photographic Science of Japan No.16, p.30 (1966), as well as lime-treated gelatin can also be used. Besides the above, the hydrolyzates or enzymolyzates of gelatin may further be used for. The gelatin derivatives applicable thereto include those prepared by reacting gelatin with a variety of compounds such as acid halides, acid anhydrides, isocyanates, bromoacetic acid, alkane-soltone, vinylsulfonamides, maleimides, polyalkylene oxides, epoxy compounds and so forth. The typical examples thereof are given in, for example, U.S. Pat. Nos. 2,614,928, 3,132,945, 3,186,846 and 3,312,553, British Patent Nos. 861,414, 1,033,189 and 1,005,784, JP Examined Publication No. 42-26845/1967 and so forth.

The proteins include, for example, albumin and casein; the cellulose derivatives include, for example, hydroxyethyl cellulose, carboxymethyl cellulose and cellulose sulfate; the sugar derivatives include, for example, sodium alginate; and a starch derivative and gelatin may also be used in combination.

The polymer latexes stabilized with gelatin, which are applicable to the invention, may be added to at least one of hydrophilic colloidal layers and, when adding them in both of a light-sensitive hydrophilic colloidal layer and a non-light-sensitive colloidal layer on the hydrophilic colloidal layer side, more better results may be obtained. The latex may be added to either one side or both sides of the layer with respect to a support.

Any conventionally known latexes may also be added to the layers to which the latexes of the invention were added and/or not added. When adding them to the both sides of a layer with respect to the support, the kinds and/or amounts of the polymer latexes contained in each side of the layer may be the same with or the different from each other.

Next, some of the typical examples of the latexes applicable to the invention will be given below. The typical examples of the latexes given in this specifications will be given as the latexes having any desired ratios of the compositions of the latexes comprising the constitutional components of the exemplified latexes. It is a matter of course that the latexes exemplified therein are the typical examples of the latexes applicable to the invention. It is, therefore, needless to say that the constitutional components (not only to the composition ratios, but without limitation) of the latexes applicable thereto shall not be limited to the following given examples thereof.

[Typical Examples of Latexes]

L-1

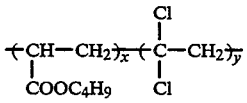

(x/y = 50/50)

L-2

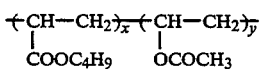

(x/y = 50/50)

L-3

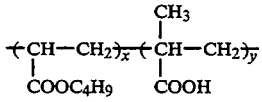

(x/y = 95.6/4.4)

-continued
L-4
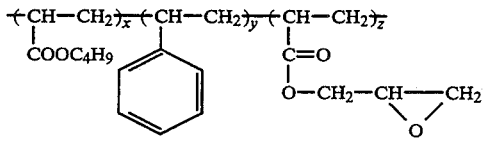
(x/y/z = 40/20/40)
L-5
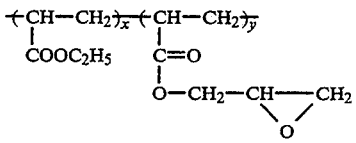
(x/y = 50/50)
L-6
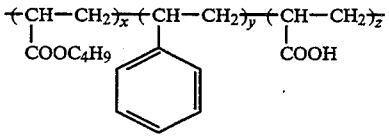
(x/y/z = 39.4/59/1.6)
L-7
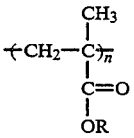
R: $-CH_3$, $C_2H_5$, $C_4H_9$
L-8
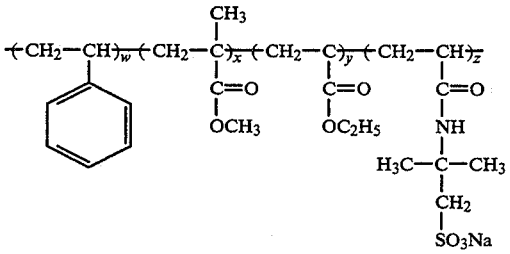
(w/x/y/z = 30/30/32/8)
L-9
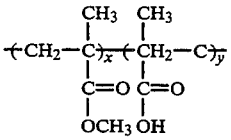
(x/y = 93/7)
L-10
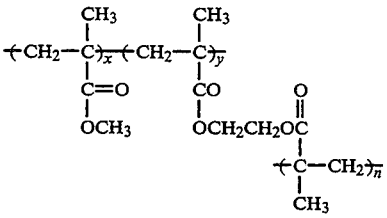
(x/y = 93/7)
L-11
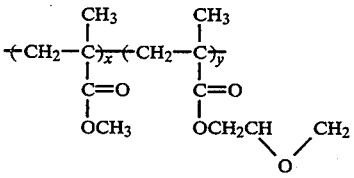
(x/y = 93/7

-continued
L-12
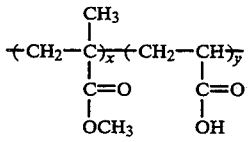
(x/y = 93/7)
L-13
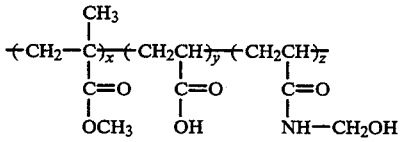
(x/y/z = 93/3/4)
L-14
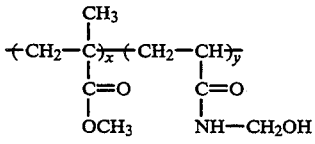
(x/y = 93/7)
L-15
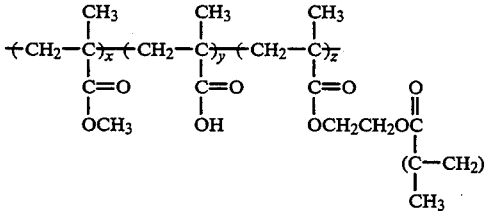
(x/y/z = 93/3/4)
L-16
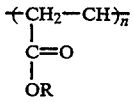
R: $-CH_3$, $-C_2H_5$, $-C_4H_9$
L-17
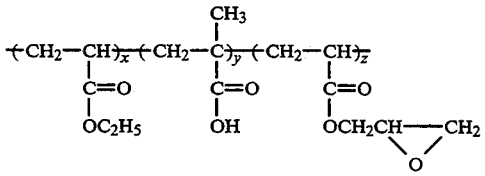
(x/y/z = 93/3/4)
L-18
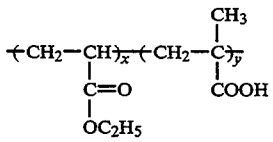
(x/y = 93/7)
L-19
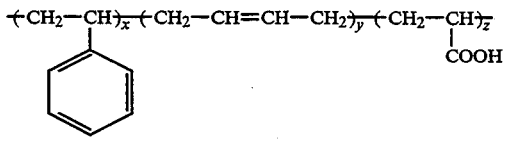
(x/y/z = 59/39/2)
L-20
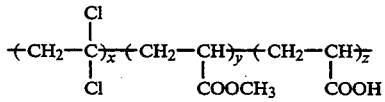
(x/y/z = 85/13/2)

-continued
L-21
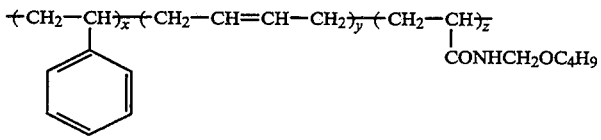
(x/y/z = 64/33/3)
L-22
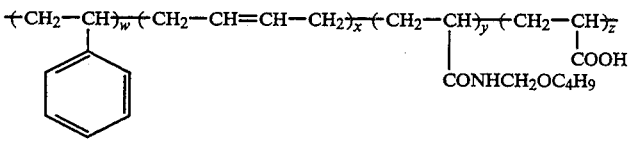
(w/x/y/z = 63/32/3/2)
L-23
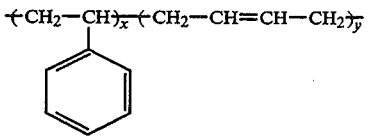
(x/y = 67/33)
L-24
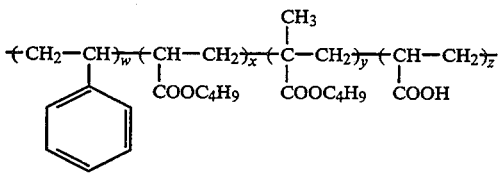
(w/x/y/z = 45/43/8/4)
L-25
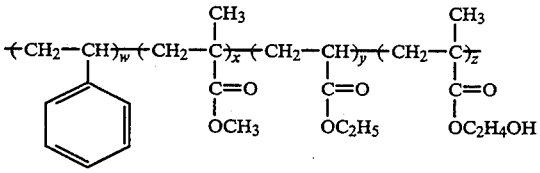
(w/x/y/z = 30/30/32/8)
L-26
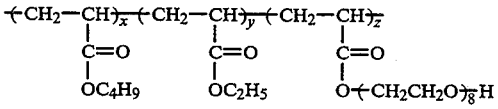
(x/y/z = 40/52/8)
Next, the typical examples of the nitrogen-containing anionic surfactants represented by Formula [FA] will be given below.
FA-1
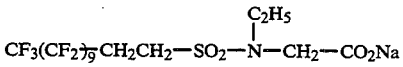
FA-2
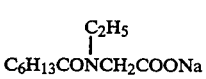
FA-3
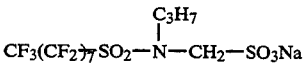
FA-4
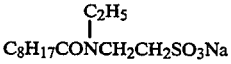
FA-5
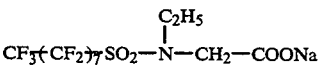
-continued
FA-6
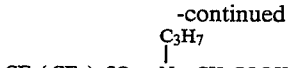
FA-7
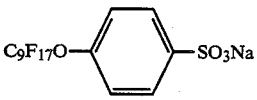
FA-8
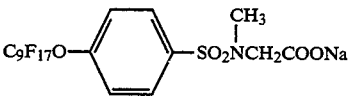
FA-9
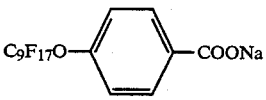

-continued
FA-10
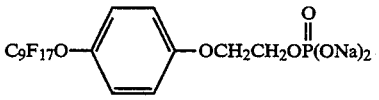
FA-11
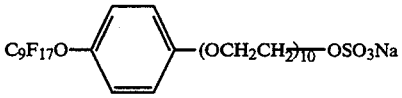
FA-12
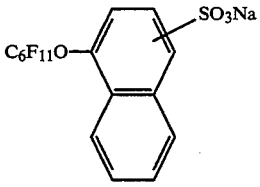
FA-13
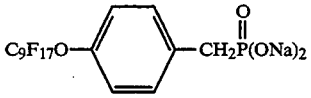
FA-14
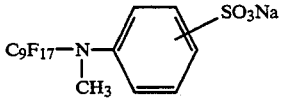
FA-15
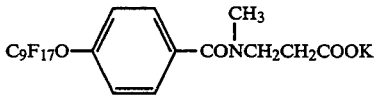
-continued
FA-16
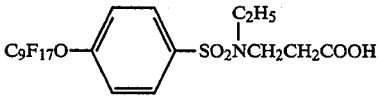
FA-17
$C_9F_{17}OCH_2CH_2SO_3Na$
FA-18
$C_9F_{17}OCH_2CH_2CH_2CH_2OP(=O)(ONa)_2$
FA-19
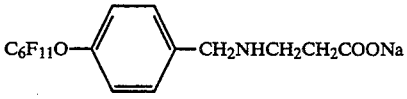
FA-20
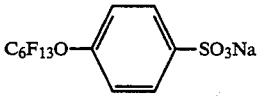
FA-21
$HCF_2(CF_2)_8OCH_2CH_2CH_2SO_3Na$
FA-22
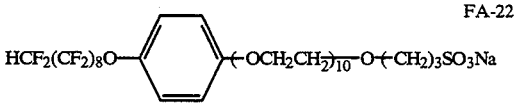
Next, the typical examples of the fluorine-containing cationic surfactants represented by Formula [FK] will be given below.
FK-1
$C_8F_{17}SO_2NH(CH_2)_3N^+(CH_3)_3.I^-$
FK-2
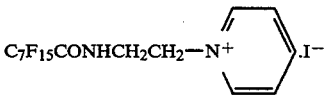
FK-3
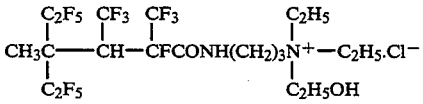
FK-4
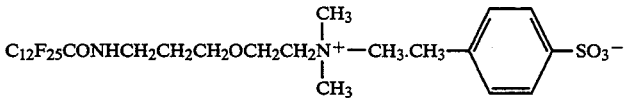
FK-5
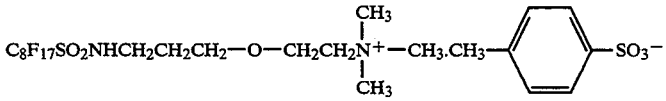
FK-6
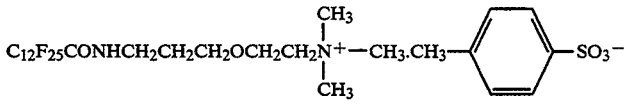
FK-7
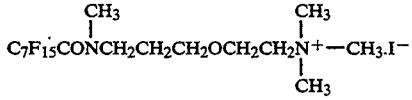

-continued

FK-8

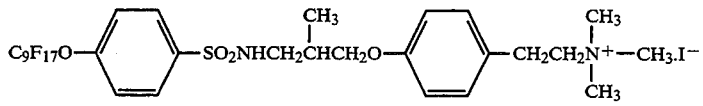

FK-9

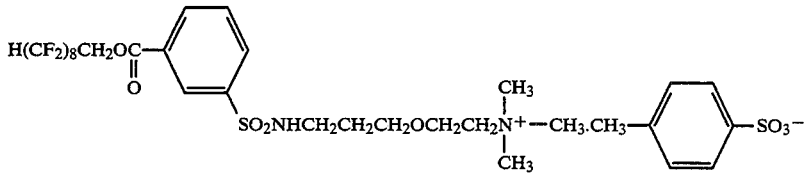

FK-10

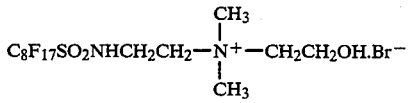

FK-11

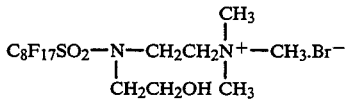

FK-12

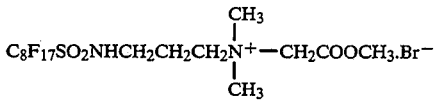

FK-13

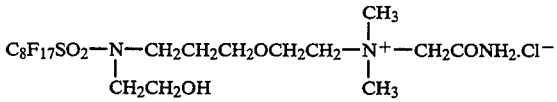

FK-14

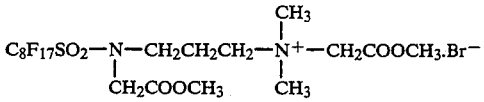

FK-15

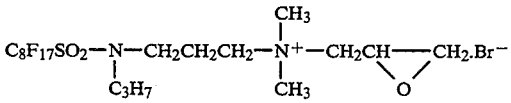

FK-16

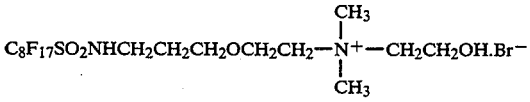

The fluorine-containing anionic or cationic surfactants each relating to the invention can be synthesized in any one of the processes described in, for example; U.S. Pat. Nos. 2,559,751, 2,567,011, 2,732,398, 2,764,602, 2,806,866, 2,809,998, 2,915,376, 2,915,528, 2,934,450, 2,937,098, 2,957,031, 3,472,894, 3,555,089 and 2,918,501, British Patent Nos. 1,143,927 and 1,130,822; JP Examined Publication No. 45-37304/1970; JP OPI Publication Nos. 47-9613/1972, 50-121243/1975, 50-117705/1976, 49-134614/1974, 50-117727/1975, 52-41182/1977 and 51-12392/1976; 'Journal of British Chemical Society', p.2789, 1950; ibid , pp 2574 & 2640, 1957; 'Journal of American Chemical Society', vol.79, p.2549, 1957; 'Journal of Japanese Oil Chemists Society', vol. 12, p. 653; and 'Journal of Organic Chemistry', vol. 30.p. 3524, 1965

Among the above-given fluorine-containing surfactants of the invention, some of them are available on the market under the following brand names of the manufacturers, namely; 'Megafac' of Dai-Nippon Ink Chemical Industrial Co.; 'Fluorad' of Minnesota Mining and Manufacturing Co.; 'Monflor' of Imperial Chemical Industries; 'Zonyls' of E. I. DuPont; and 'Licowet' of Farbwerke Hoechst.

The surfactants represented by Formulas [FA] and [FK] may be added independently and, especially, more preferable effects may be obtained when making combination use of them. These surfactants may be added to the outermost layer either on the emulsion layer side of a support or on the opposite side of the support. However, the preferable results may be obtained when they are added to the outermost layer on the side of the layers containing a polymer latex stabilized with gelatin. The preferable results may be obtained when they are added to each of the above-mentioned layer sides in an amount within the range of 0.5 to 50 mg/m$^2$. When making combination use of them, the total adding amounts would preferably be not more than 100 mg/m$^2$. These surfactants may be added upon dissolving them in water or alcohol.

In the invention, the term, 'a hydrophilic colloidal layer', means a layer comprising gelatin mainly serving as the binder. It is allowed to use the same gelatin as those applicable to stabilize the latexes of the invention.

The emulsions of the invention can be used with any well-known additives and there is no special limitation to the processes for preparing, sensitizing the silver halide grains and so forth. For the details, JP OPI Publication No. 63-230035/1988. JP Application No. 1-266640/1989 and so forth may be referred.

It is preferable to add at least one kind of any known contrast-increasing agents such as tetrazolium compounds and hydrazine derivatives.

In the invention and for preventing a static charge that is another physical property of light sensitive materials, it is allowed to provide one or more antistatic layers to the backing layer side and/or to the emulsion layer side of a support.

When this is the case, the specific surface resistance on the antistatic layer side is to be, preferably not higher than $1.0\times10^{11}\Omega$ and, more preferably not higher than $8\times10^{11}\Omega$, at 25° C. and 50% RH.

The above-mentioned antistatic layers include, preferably, an antistatic layer containing a water-soluble conductive polymer, hydrophobic polymer particles and the reactants of a hardening agent, an antistatic layer containing a metal oxide, and so forth.

The above-mentioned water-soluble conductive polymers include, for example, a polymer having at least one conductive group selected from the group consisting of a sulfonic acid group, a sulfate group, a quaternary ammonium salt, a tertiary ammonium salt, a carboxyl group and a polyethylene oxide group. Among the above-given groups, a sulfonic acid group, a sulfate group and a quaternary ammonium salt group are preferable. The proportion of the conductive groups is to be not less than 5 wt % per molecule of the water-soluble conductive polymer.

The above-mentioned water-soluble conductive polymers contain each a carboxyl group, a hydroxy group, an amino group, an epoxy group, an aziridine group, an active methylene group, a sulfinic acid group, an aldehyde group, a vinylsulfone group and so forth. Among them, a carboxyl group, a hydroxy group, an amino group, an epoxy group, an aziridine group and an aldehyde group are preferable to be contained. These groups are to be contained in a proportion of not less than 5 wt % per molecule of the polymer. The number average molecular weight of such a water-soluble conductive polymer as mentioned above is within the range of 3000 to 100000 and, preferably, 3500 to 50000.

The above-mentioned metal oxides preferably contained in the antistatic layers include, for example, tin oxide, indium oxide, antimony oxide, vanadium oxide and the metal oxides doped with metallic silver, metallic phosphorus or metallic indium. The average particle size of the metal oxides is preferably within the range of $1\mu$ to $0.01\mu$.

Further, when the lower layer is an emulsion layer, a matting agent permeates into the emulsion layer with pressure, because the emulsion layer is still soft. Therefore, a coating trouble is caused by partially destroying the emulsion layer. The same trouble is also caused by a reeling (or taking) tension.

Any one of the known matting agents may be used in the invention. They include, for example, inorganic matters such as silica given in Swiss Patent No. 330,158, glass powder given in French Patent No. 1,296,995 and alkaline earth metals or carbonates of cadmium or zinc; organic matters such as starch given in U.S. Pat. No. 2,322,037, the starch derivatives given in Belgian Patent No. 625,451 or British Patent No. 981,198, polyvinyl alcohol given in JP Examined Publication No. 44-3643/1969, polystyrene or polymethyl methacrylate given in Swiss Patent No. 330,158, polyacrylonitrile given in U.S. Pat. No. 3,079,257 and polycarbonates given in U.S. Pat. No. 3,022,169.

These matting agents may be used independently or in combination. As the definitely formed matting agents, those in the globular forms are preferable, however, those in the other forms such as the tabular or cubic forms may also be used. The sizes of the matting agents are expressed in the terms of a diameter of a globular form obtained when converting the volume of a matting agent into a globular form. In the invention, the particle size of a matting agent means the diameter of a globular form converted as mentioned above.

The preferable embodiment of the invention is preferable that the outermost layer on an emulsion layer side contains at least one kind of a definitely and/or amorphously formed matting agent having a particle size of not smaller than 4 $\mu$m in an amount within the range of 4 to 80 mg/m$^2$ and it is more preferable to contain at least one kind of a definitely and/or amorphously formed matting agent having a particle size of smaller than 4 $\mu$m in an amount within the range of 4 to 80 mg/m$^2$.

The expression, 'a matting agent is contained in the outermost layer . . .', means that at least a part of the matting agent is preferably contained in the outermost layer and also means that a part of the matting agent may permeate into the outermost layer down to the lower layers.

For performing the basic functions of a matting agent, it is preferable to expose a part of the matting agent to the surface of a subject layer. It is also allowed that either a part of or the whole of the matting agent may be exposed to the surface. Such a matting agent can be coated in such a method that it is coated upon dispersing it in a coating solution in advance or that, after coating a coating solution, a matting agent is sprayed on the coated surface before the coated surface is completely dried up. When adding a plurality of different kinds of matting agents, both of the above-mentioned adding methods may be used in combination. The techniques for further effectively adding a matting agent into a light sensitive material are detailed in JP Application No. 1-228762/1989 and so forth.

The sublayers applicable to the invention include, for example; the subbing-processed layers prepared in an organic solvent system containing a polyhydroxybenzene, such as detailed in JP OPI Publication No. 49-3972/1974; the aqueous type latex subbing-processed layers detailed in JP OPI Publication Nos. 49-11118/1974, 52-104913/1977, 59-19941/1984, 59-19940/1984, 59-18945/1984, 51-112326/1976, 51-117617/1976, 51-58469/1976, 51-114120/1976, 51-121323/1976, 51-123139/1976, 51-114121/1976, 52-139320/1977, 52-65422/1977, 52-109923/1977, 52-119919/1977, 55-65949/1980, 57-128332/1982, 59-19941/1984 and so forth; the vinylidene chloride type sublayers detailed in U.S. Pat. Nos. 2,698,235, 2,779,684, 425,421, 4,645,731 and so forth.

The above-mentioned sublayers may be chemically or physically treated on the surfaces thereof. The treatments include, for example, the surface activation treatments such as a chemical treatment, a mechanical treatment, a corona-discharge treatment, a flame treatment, a UV-ray treatment, a high-frequency treatment, a grow-discharge treatment, an active-prasma treatment, a laser treatment, a mixed-acid treatment and an ozone-oxidation treatment. Such a sublayer as mentioned above is discriminated from the coating layers relating to the invention and there is no special limitation to the coating points of time and the coating conditions.

However, the embodiments of the invention can display more remarkable effects when coating on a vinylidene chloride type sublayered polyester support.

In the invention, a solid particle dispersion dye, besides the ordinary water-soluble dyes, may also be contained in any one of hydrophilic colloidal layers. The very layer may be the outermost layer on an emulsion surface side. For the purpose of preventing any halation, such a dye as mentioned above may also be added to a layer on the lower side of the emulsion layers and/or to a backing surface side. Further, a suitable amount of the dyes may be added to an emulsion layer for controlling an irradiation. It is a matter of course that a plurality of solid particle dispersion dyes may be contained in a plurality of layers.

The solid particle dispersion dyes may be added in an amount within the range of, preferably 5 mg/m$^2$ to 1 g/m$^2$ and, more preferably 10 mg/m$^2$ to 800 mg/m$^2$, each per one kind of the dyes.

The fine particles of the solidly dispersed dyes applicable thereto may be prepared by pulverizing the dyes by making use of a dispersing machine such as a ball-mill and a sand-mill and then by dispersing them together with a surfactant including, for example, a hydrophilic colloid such as gelatin, sodium dodecylbenzene sulfonate, sodium fluoroctylbenzene sulfonate, saponin, nonylphenoxy polyethylene glycol.

The formulas representing the dyes applicable to the invention may be given as those indicated in U.S. Pat. No. 4,857,446 and so forth. The dyes preferably applicable thereto include, for example, those represented by Formulas [I] through IV].

The invention can be applied to a variety of light sensitive materials including, for example, those for printing use, X-ray use, general negative use, general reversal use, general positive use, direct positive use and so forth. Particularly when applying them to a light sensitive materials for printing use which is essential to have a high dimensional stability, remarkable effects can be enjoyed.

The developers applicable to the above-mentioned photographic light sensitive materials are those containing the following developing agents. The black-and-white developing agents include, for example, a dihydroxybenzene (such as hydroquinone, chlorohydroquinone, bromohydroquinone, isopropyl hydroquinone, methyl hydroquinone, 2,3-dichlorohydroquinone, 2,5-dimethyl hydroquinone, potassium hydroquinone monosulfonate and sodium hydroquinone monosulfonate), a 3-pyrazolidone (such as 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone and 1-phenyl-4,4-dihydroxymethyl-3-pyrazolidone), an aminophenol <such as o-aminophenol, p-aminophenol, N-methyl-o-aminophenol, N-methyl-p-aminophenol and 2,4-diaminophenol), a 1-aryl-3-aminopyrazoline (such as 1-(p-hydroxyphenyl)-3-aminopyrazoline, 1-(p-methylaminophenyl)-3-aminopyrazoline and 1-(p-amino-m-methylphenyl)-3-aminopyrazoline>, or the mixtures thereof.

Besides the above, it is also allowed to use those given in L. F. A. Mason, 'Photographic Processing Chemistry' (Focal Press, 1966) pp.226~229; JP OPI Publication No. 48-64933/1973; and so forth.

These developing agents may be used in an amount within the range of, usually 0.1 to 80 g/liter and, preferably the order of 0.2 to 50 g/liter.

The silver halide photographic light sensitive materials of the invention may be developed at a temperature of preferably not higher than 50° C. and, more preferably within the range of 25° to 40° C. The developments of these light sensitive materials are generally completed within two minutes and, particularly when a rapid development is carried out within the range of 5 to 60 seconds, more preferable results may be obtained.

EXAMPLES

Some examples of the invention will be detailed below. It is needless to say that the invention shall not be limited to the examples given herein.

Example 1

(Synthesis of Comparative Latex Lx-A)

To a solution prepared by adding 0.01 kg of sodium dodecylbenzene sulfonate and 0.05 kg of ammonium persulfate to 40 liters of water, (a) 3.0 kg of styrene, (b) 3.0 kg of methyl methacrylate, (c) 3.2 kg of ethyl acrylate and (d) 0.8 kg of 2-acryl amido-2-methylpropane sulfonic acid were each added while stirring the solution at 60° C. in an atmosphere of nitrogen by taking one hour. After that, the mixed solution was stirred for 1.5 hours and was then steam-distilled for one hour. The residual monomers were removed therefrom and the resulting solution was cooled down to room temperature. After that, the pH was adjusted to be 6.0 with sodium hydroxide. The resulting latex solution was finished by adding water to make 55 kg. In the above-mentioned manner, a monodisperse type latex having an average particle size of 0.11 μm could be prepared.

(Latex Lx-B)

To a solution prepared by adding 1.0 kg of gelatin, 0.01 kg of sodium dodecylbenzene sulfonate and 0.05 kg of ammonium persulfate to 60 liters of water, (a) 3.0 kg of styrene, (b) 3.0 kg of methyl methacrylate, (c) 3.2 kg of ethyl acrylate and (d) 0.8 kg of sodium salt of 2-acryl amido-2-methylpropane sulfonic acid were each added while stirring the solution at 60° C. in an atmosphere of nitrogen by taking one hour. After that, the mixed solution was stirred for 1.5 hours and was then steam-distilled for one hour. The residual monomers were removed therefrom and the resulting solution was cooled down to room temperature. After that, the pH was adjusted to be 6.0 with ammonia. The resulting latex solution was finished by adding water to make 75 kg. In the above-mentioned manner, a monodisperse type latex having an average particle size of 0.1 μm could be prepared.

(Latex Lx-C)

To a solution prepared by adding 0.01 kg of sodium dodecylbenzene sulfonate and 0.05 kg of ammonium persulfate to 40 liters of water, a mixed solution of (a) 9.3 kg of ethyl acrylate, (b) 0.4 kg of the reactant of epichlorohydrin and acrylic acid and (c) 0.3 kg of acrylic acid ethyl was added while stirring the solution at 80° C. in an atmosphere of nitrogen by taking one hour. After that, the mixed solution was stirred for 1.5 hours and, after completing the reaction, the solution was then steam-distilled for one hour. After the residual monomers were removed therefrom, the resulting solution was cooled down to room temperature. After that, the pH was adjusted to be 6.0 with ammonia. The resulting latex solution was finished by adding water to make 55 kg. In the above-mentioned manner, a monodisperse type latex having an average particle size of 0.12 μm could be prepared.

(Emulsion preparation)

A silver sulfate solution and a solution prepared by adding rhodium hexachloride to an aqueous solution of sodium chloride and potassium chloride so as to be $8\times10^{-5}$ mols/mol of Ag, both of the solutions were simultaneously added into a gelatin solution with controlling the flow rate. After desalting therefrom, a cubic, monodisperse type silver chlorobromide emulsion having a grain size of 0.13 μm and a silver bromide content of 1 mol % could be prepared.

The resulting emulsion was sulfur-sensitized in an ordinary method and, after 6-methyl-4-hydroxy-1,3,3a,7-tetrazaindene was added as a stabilizer to the resulting sensitized emulsion, the following additives were added thereto, so that emulsion coating solutions E-1 through E-11 were each prepared. Next, emulsion protective layer coating solution P-0, backing layer coating solution B-0 and backing-protective layer coating solution BP-0 were each prepared so as to have the following compositions.

| (Preparation of Emulsion Coating Solutions E-1 through E-11) | |
|---|---|
| Potassium bromide | 5 mg/m$^2$ |
| Compound (a) | 1 mg/m$^2$ |
| NaOH (0.5 N) | Adjusted to be pH 5.6 |
| Compound (b) | 40 mg/m$^2$ |
| Saponin (20%) | 0.5 ml/m$^2$ |
| Sodium dodecylbenzene sulfonate | 20 mg/m$^2$ |
| 5-methylbenzotriazole | 10 mg/m$^2$ |
| Compound (d) | 2 mg/m$^2$ |
| Compound (e) | 10 mg/m$^2$ |
| Compound (f) | 6 mg/m$^2$ |
| Latex Lx | See Table 1 |
| Styrene-maleic acid copolymer (a thickening agent) | 90 mg/m$^2$ |

When coating the emulsion, the emulsion was so coated as to have a gelatin content of 1.2 g/m$^2$.

Compound (a)

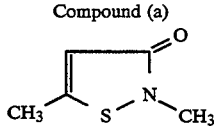

Compound (b)

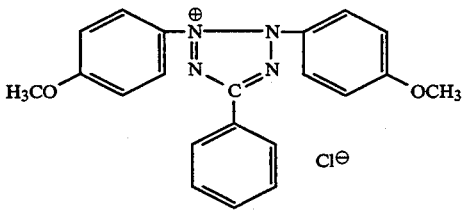

Compound (d)

-continued

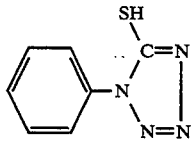

Compound (e)

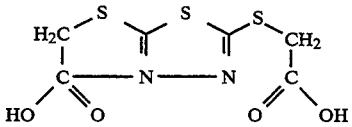

Compound (f)

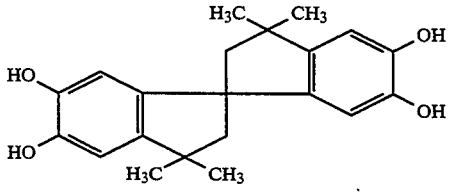

| (Emulsion-protective layer coating solution P-0) | |
|---|---|
| Gelatin | 1.1 g/m$^2$ |
| Compound (g) (1%) | 25 ml/m$^2$ |
| Compound (h) | 40 mg/m$^2$ |
| Compound (k) | 100 mg/m$^2$ |
| Globular-shaped monodisperse silica (8μ) | 20 mg/m$^2$ |
| Globular-shaped monodisperse silica (3μ) | 10 mg/m$^2$ |
| Compound (i) | 100 mg/m$^2$ |
| Fluorine-containing surfactant of the invention | See Table 1 |
| Citric acid | Adjusted to be pH 5.8 |
| Latex Lx of the invention | See Table 1 |
| Styrene-maleic acid copolymer (a thickening agent) | 50 mg/m$^2$ |
| Formaldehyde (a hardening agent) | 10 mg/m$^2$ |
| (Backing layer coating solution B-0) | |
| Gelatin | 1.0 g/m$^2$ |
| Compound (j) | 80 mg/m$^2$ |
| Compound (k) | 15 mg/m$^2$ |
| Compound (l) | 150 mg/m$^2$ |
| Calcium chloride | 0.3 mg/m$^2$ |
| Saponin (20%) | 0.6 cc/m$^2$ |
| Citric acid | Adjusted to be pH 5.5 |
| Latex (m) | 300 mg/m$^2$ |
| 5-methylbenzotriazole (2-2) | 10 mg/m$^2$ |
| 5-nitroindazole (2-18) | 20 mg/m$^2$ |
| Polyethylene glycol, (molecular weight: 1540) (1-16) | 10 mg/m$^2$ |
| Styrene-maleic acid copolymer, (a thickening agent) | 45 mg/m$^2$ |
| Glyoxal | 4 mg/m$^2$ |
| Compound (n) | 80 mg/m$^2$ |
| (Backing-protective layer coating solution BP-0) | |
| Gelatin | 1.18 g/m$^2$ |
| Compound (g) (1%) | 2 ml/m$^2$ |
| Compound (j) | 20 mg/m$^2$ |
| Compound (k) | 4 mg/m$^2$ |
| Compound (l) | 50 mg/m$^2$ |
| Globular-shaped polymethyl methacrylate (4μ) | 25 mg/m$^2$ |
| Sodium chloride | 70 mg/m$^2$ |
| Fluorine-containing surfactant of the invention | See Table 1 |
| Glyoxal | 22 mg/m$^2$ |
| Bisvinyl sulfonyl methyl ether | 5 mg/m$^2$ |

-continued (g)

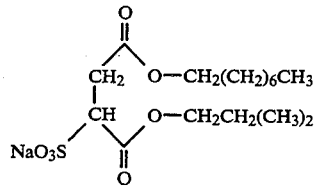

(h)

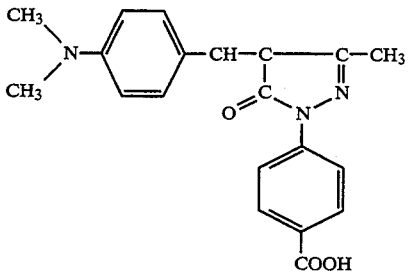

(solid particle-dispersed dye)

(i)

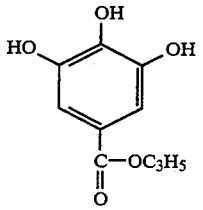

(j)

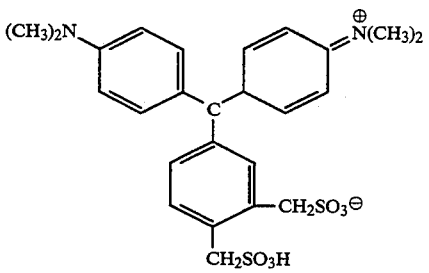

-continued (k)

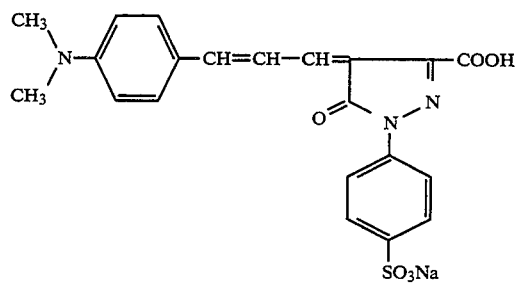

(l)

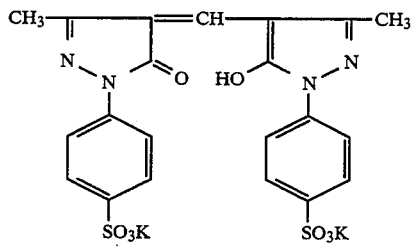

(m)

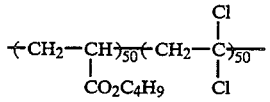

(n)

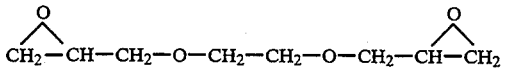

After applying a corona-discharge at 10W/(m$^2$.min), each of the resulting coating solutions was coated, by making use of a roll-fit coating pan and an air-knife, over a 100 g-thick subbed polyethylene terephthalate base as shown in JP OPI Publication No. 59-19941/1984 so as to have the following compositions and the amount coated of 100 cc/m$^2$. The drying treatment was carried out for 30 minutes under the parallel-flow drying conditions of 90° C. and an overall heat-transfer coefficient of 25 Kcal (m$^2$.hr.° C.), and another drying treatment was successively carried out for 90 seconds at 140° C. The dried thickness of the resulting layer was 1$\mu$ and the specific surface resistance of the layer was $1\times10^8\Omega$ at 23° C. and 55% RH.

| | |
|---|---|
| Water-soluble conductive polymer | 70 g/l |

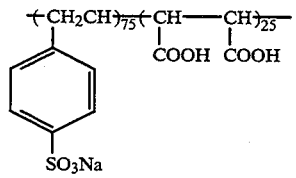

$\overline{MW}$ = 5000

| | |
|---|---|
| Hydrophobic polymer grains | 40 g/l |

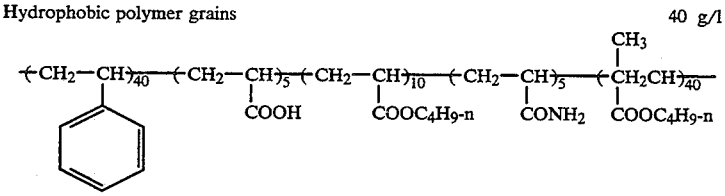

| | |
|---|---|
| Ammonium sulfate | 0.5 g/l |
| Polyethylene oxide compound (average molecular weight 600) | 6 g/l |
| Hardener | 12 g/l |

-continued

Mixture of

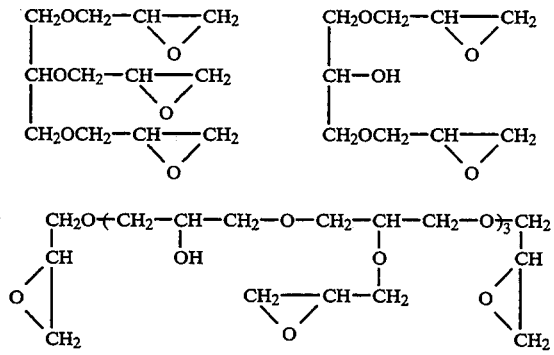

First, on the above-mentioned base, an emulsion layer and an emulsion-protective layer were double-coated simultaneously as the side of the emulsion layer, in order from the side near the support, while keeping a temperature of 35° C. and adding a layer hardening agent in a slide-hopper system and the resulting layer-coated base was passed through a cool-air set zone (at 5° C.). After that, a backing layer and a backing-protective layer were similarly coated by a slide-hopper while adding a layer hardening agent and were then set (at 5° C.) by blowing cool-air. At the point of time when passing through each of the set zones, the coating solutions could display the satisfactory setting characteristics. Successively, the both sides of the coated base was dried up simultaneously in the drying zone under the following drying conditions. After coating the backing layer, the coated base was transported without bringing itself into any contact at all with a roller or others until it was taken up. The coating speed at that time was 100 m/min.

(Drying conditions)

After completing the setting, it was dried by blowing dried-air at 30° C. until the ratio by weight of $H_2O$/-gelatin was at 800% and was then dried by blowing dried-air (of 30% RH) at 35° C. while the ratio thereof was between 800 to 200%. Even after dried up, dried-air was still blown as it was and, when 30 seconds after the point of time when the surface temperature became 34° C. (that was regarded as the completion of the drying treatments), another drying treatment was made for one minute by blowing dried-air (of 2% RH) at 42° C. At that time, the first drying time was 50 seconds from the time when starting the drying treatment to the time when the ratio of $H_2O$/Gel became 800%, the second drying time was 35 seconds between 800% to 200%, and the final drying time was 5 seconds from the time when the ratio became 200% to the time when the drying treatment was completed.

The resulting light sensitive material was taken up at 23° C. and 40% RH and was then cut apart in the same atmospheric conditions. In the same atmospheric conditions, the cut pieces were air-tight wrapped, together with a sheet of cardboard, in a 3h-rehumidified barrier-envelope (which was rehumidified to be 23° C. and 40% RH for 2 hours after rehumidifying to be at 40° C. and 10% RH for 8 hours).

TABLE 1

| Sample No. | Emulsion layer Type of Lx | Emulsion layer Amount*1 g/m² | Emulsion layer Gelatin amount coated*2 | Emulsion-protective layer Type of Lx | Emulsion-protective layer Amount*1 g/m² | Emulsion-protective layer Gelatin amount coated*2 | Emulsion-protective layer Fluorine-containing surfactant | Emulsion-protective layer Amount mg/m² | Backing-protective layer Fluorine-containing surfactant | Backing-protective layer Amount mg/m² | Backing-protective layer Gelatin amount coated*3 | Remarks |
|---|---|---|---|---|---|---|---|---|---|---|---|---|
| 1 | — | — | 1.2 | — | — | 1.1 | — | — | — | — | 2.7 | Comp. |
| 2 | A | 0.5 | 1.2 | A | 0.5 | 1.1 | — | — | — | — | 2.7 | Comp. |
| 3 | C | 0.5 | 1.2 | C | 0.5 | 1.1 | a | 1.5 | a | 1.5 | 2.7 | Comp. |
| 4 | C | 0.5 | 1.2 | C | 0.5 | 1.1 | FA-7 | 1.5 | — | — | 2.7 | Inv. |
| 5 | C | 0.5 | 1.2 | C | 0.5 | 1.1 | FA-7 | 1.5 | FA-7 | 1.5 | 2.7 | Inv. |
| 6 | B | 0.5 | 1.2 | B | 0.5 | 1.1 | FA-7 | 1.5 | — | — | 2.7 | Inv. |
| 7 | B | 0.5 | 1.2 | B | 0.5 | 1.1 | FA-7 | 1.5 | FA-7 | 1.5 | 2.7 | Inv. |
| 8 | B | 0.5 | 1.2 | B | 0.5 | 1.1 | FA-4 | 2.0 | — | — | 2.7 | Inv. |
| 9 | B | 0.5 | 1.2 | B | 0.5 | 1.1 | FA-5 | 2.0 | — | — | 2.7 | Inv. |
| 10 | B | 0.5 | 1.2 | B | 0.5 | 1.1 | FA-4 | 2.0 | — | — | 2.7 | Inv. |
| | | | | | | | FA-5 | 2.0 | — | — | 2.7 | Inv. |
| 11 | B | 0.5 | 1.2 | B | 0.5 | 1.1 | FA-4 | 2.0 | FA-4 | 2.0 | 2.7 | Inv. |
| | | | | | | | FA-5 | 2.0 | FA-5 | 2.0 | 2.7 | Inv. |

Comp.: Comparison
Inv.: Invention
Comparative compound a

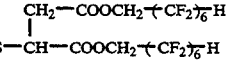

*1Amount for the solid component of a latex
*2Amount also including the amount brought-in from a latex
*3Amount totaling the amounts brought-in from the backing and backing-protective layers In the resulting light sensitive material, the silver amount coated was 3.5 g/m².

By making use of the resulting evaluation samples 1 through 11, the running stabilities and oil-sludge production were each evaluated in the following manners.

(Evaluation of Running Process Stabilities)

By making use of the following processing solutions and an automatic processor, Model GR-27 (manufactured by Konica Corp.), 150 $m^2$ each of the samples was continuously processed. At that time, a continuously running process was carried out while replenishing the developer and fixer each in an amount of 130 ml per sq.meter of each subject processed sample and keeping the blackened area of each sample to be 20%. The variations of the sensitivities and contrast of the films obtained before and after carrying out the running process were evaluated as the running stabilities.

(Evaluation of Oil-Sludges)

After carrying out the process in the same conditions as in the evaluation of the running stabilities, the subject samples were allowed to stand for 30 minutes. The hardly-soluble components thereof were liable to be deposited thereby. After elapsing 30 minutes, the degrees of the oil-sludge production were evaluated through the same sample unexposed to light as the sample used in the running process.

The oil-sludges appeared to be spot-shaped on the surface of the sample. The resulting oil-sludges were evaluated by 4 grades, A through D.

A: No spot appeared; B: 1~3 spots appeared; C: 3~5 spots appeared; and D: 5~not less than 10 spots appeared.

The conditions for the development process were as follows.

| (Processing step) | (Temperature) | (Time) |
|---|---|---|
| Developing | 28° C. | 30 sec. |
| Fixing | 28° C. | 20 sec. approx. |
| Washing | At ordinary temp. | 20 sec. approx. |

[Formula of Developer-1]

| | |
|---|---|
| (Composition A) | |
| Pure water (i.e., ion-exchange water) | 150 ml |
| Disodium ethylenediamine tetraacetate | 2 g |
| Diethylene glycol | 50 g |
| Potassium sulfite (in an aqueous 55% W/V solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide | An amount to make the pH of a subject solution to be 10.9 |
| Potassium bromide | 4.5 g |
| (Composition B) | |
| Pure water (i.e., ion-exchange water) | 3 ml |

-continued

| | |
|---|---|
| Acetic acid (in an aqueous 90% solution) | 0.3 ml |
| 5-nitroindazole | 110 mg |
| 1-phenyl-3-pyrazolidone | 500 mg |

When making use of the developer, the above-given Compositions A and B were dissolved in order in 500 ml of water and water was added to the resulting solution so as to make one liter.

[Formula of Fixer]

| | |
|---|---|
| (Composition A) | |
| Ammonium thiosulfate, (in an aqueous 72.5% W/V solution) | 230 ml |
| Sodium sulfite | 9.5 g |
| Sodium acetate · trihydrate | 28.9 g |
| Boric acid | 6.7 g |
| Sodium citrate · dehydrate | 2 g |
| Acetic acid (in an aqueous 90% W/W solution) | 12 ml |
| (Composition B) | |
| Pure water (i.e., ion-exchange water) | 17 ml |
| Sulfuric acid (in an aqueous 50% W/W solution) | 5.8 g |
| Aluminium sulfate (in an aqueous solution containing an amount equivalent to 8.1% W/W of $Al_2O_3$) | 26.5 g |

When making use of the fixer, the above-given Compositions A and B were dissolved in order into 500 ml of water and the total amount was made to be one liter. The pH of the resulting fixer was approximately 4.5.

TABLE 2

| | Photographic characteristic variation before and after processing treatment | | | | Oil-sludge degrees before and after processing treatment | | |
|---|---|---|---|---|---|---|---|
| | Sensitivity | | γ | | | | |
| Sample No. | Before running | After running | Before running | After running | Before running | After running | Remarks |
| 1 | 100 | 80 | 11.0 | 8.0 | A | D | Comparison |
| 2 | 100 | 85 | 11.0 | 9.0 | A | C | Comparison |
| 3 | 100 | 105 | 11.0 | 10.0 | A | B | Comparison |
| 4 | 100 | 100 | 11.0 | 11.0 | A | A | Invention |
| 5 | 100 | 100 | 11.0 | 11.0 | A | A | Invention |
| 6 | 100 | 100 | 11.0 | 11.0 | A | A | Invention |
| 7 | 100 | 100 | 11.0 | 11.0 | A | A | Invention |
| 8 | 100 | 100 | 11.0 | 11.0 | A | A | Invention |
| 9 | 100 | 100 | 11.0 | 11.0 | A | A | Invention |
| 10 | 100 | 100 | 11.0 | 11.0 | A | A | Invention |
| 11 | 100 | 100 | 11.0 | 11.0 | A | A | Invention |

In the table, γ indicates the contrast.

From the results shown in Table 2, it was proved that the samples relating to the invention are excellent in running characteristics.

Example 2

Samples No.12 through No.22 were each prepared in the same manner as in Example No.1, except that tetrazolium compound (T) used in Example No.1 was replaced by hydrazine compound (HD) as a contrast increasing agent.

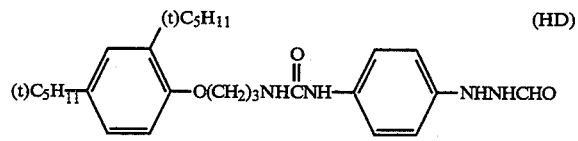

The results will be shown in Table 3 given below.

TABLE 3

| Sample No. | Photographic characteristic variation before and after processing treatment: Sensitivity Before running | Sensitivity After running | γ Before running | γ After running | Oil-sludge degrees before and after processing treatment: Before running | After running | Remarks |
|---|---|---|---|---|---|---|---|
| 12 | 100 | 130 | 12.0 | 8.0 | A | D | Comparison |
| 13 | 100 | 120 | 12.0 | 9.5 | A | C | Comparison |
| 14 | 100 | 115 | 12.0 | 10.5 | A | B | Comparison |
| 15 | 100 | 105 | 12.0 | 11.5 | A | A | Invention |
| 16 | 100 | 102 | 12.0 | 12.0 | A | A | Invention |
| 17 | 100 | 100 | 12.0 | 12.0 | A | A | Invention |
| 18 | 100 | 100 | 12.0 | 12.0 | A | A | Invention |
| 19 | 100 | 100 | 12.0 | 12.0 | A | A | Invention |
| 20 | 100 | 100 | 12.0 | 12.0 | A | A | Invention |
| 21 | 100 | 100 | 12.0 | 12.0 | A | A | Invention |
| 22 | 100 | 100 | 12.0 | 12.0 | A | A | Invention |

From the results shown in Table 3, it was proved that the samples of the invention were excellent in running characteristics and few in oil-sludge production.

As for the developer, Developer-2 having the following composition was used, and the developing conditions were set to be at 38° C. and for 20 seconds.

| [Formula of Developer-2] | |
|---|---|
| Hydroquinone | 45.0 g |
| N-methyl-p-aminophenol ½ sulfate | 0.8 g |
| Sodium hydroxide | 15.0 g |
| Potassium hydroxide | 55.0 g |
| 5 · sulfosalicylic acid | 45.0 g |
| Boric acid | 35.0 g |
| Potassium sulfite | 110 g |
| Disodium ethylenediaminetetraacetate | 1.0 g |
| Potassium bromide | 6.0 g |
| 5-methylbenzotriazole | 0.6 g |
| n-butyl · diethanolamine | 15.0 g |
| Add water to make | 1 liter |
| Adjust pH to be | pH 11.6 |

Example 3

The running processes were carried out in the same manner as in Example 1, except that the processing conditions were changed as follows. However, the contents of the samples and the compositions of the developer and fixer were each as same as those used in Example 1.

| (Processing Conditions) (Processing step) | (Temperature) | (Time) |
|---|---|---|
| Developing | 35° C. | 9 sec. |
| Fixing | 35° C. | 6 sec. |
| Washing | at ordinary temp. | 6 sec. |
| Drying | 45° C. | 9 sec. |

The results will be shown in Table 4 given below.

TABLE 4

| Sample No. | Photographic characteristic variation before and after processing treatment: Sensitivity Before running | Sensitivity After running | γ Before running | γ After running | Oil-sludge degrees before and after processing treatment: Before running | After running | Remarks |
|---|---|---|---|---|---|---|---|
| 1 | 100 | 75 | 10.5 | 7.5 | A | D | Comparison |
| 2 | 100 | 80 | 10.5 | 8.0 | A | C | Comparison |
| 3 | 100 | 95 | 10.5 | 10.0 | A | B | Comparison |
| 4 | 100 | 100 | 10.5 | 10.5 | A | A | Invention |
| 5 | 100 | 100 | 10.5 | 10.5 | A | A | Invention |
| 6 | 100 | 100 | 10.5 | 10.5 | A | A | Invention |
| 7 | 100 | 100 | 10.5 | 10.5 | A | A | Invention |
| 8 | 100 | 100 | 10.5 | 10.5 | A | A | Invention |
| 9 | 100 | 100 | 10.5 | 10.5 | A | A | Invention |
| 10 | 100 | 100 | 10.5 | 10.5 | A | A | Invention |
| 11 | 100 | 100 | 10.5 | 10.5 | A | A | Invention |

From the results shown in Table 4, it was proved that the samples of the invention were excellent in running characteristics and few in oil-sludge production.

The invention can provide an excellent silver halide photographic light sensitive material; wherein a high contrast can be kept and only a few sensitivity and contrast are deteriorated even if it is running-processed; the high level characteristics can also be displayed even in a low-replenishing state; and the hardly soluble components of the light sensitive material cannot be deposited in a developer.

What is claimed is:

1. A silver halide photographic light-sensitive material comprising a support having thereon hydrophilic colloidal layers including a silver halide emulsion layer and a backing layer on the back side of the support, wherein said backing layer contains a compound having a repeating unit represented by the formula [1] or a compound of formula [2]; at least one of the hydrophilic colloidal layers contains a polymer latex dispersion-stabilized with gelatin; and said latex comprising polymer particles which are formed by addition of said gelatin before or during polymerization so as to bond said gelatin to said polymer particles; an outermost layer of the hydrophilic colloidal layers or an outermost layer on the opposite side thereto contains a fluorine-containing surfactant represented by the following formula [FA] or formula [FK],

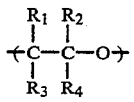

formula [1]

wherein $R_1$ through $R_4$ each represent a hydrogen atom, a halogen atom, a carbonyl or sulfo group, an alkyl, aryl, alkenyl or alkoxy group,

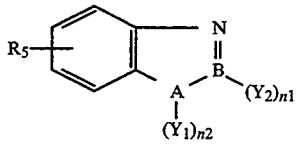

formula [2]

wherein $Y_1$ and $Y_2$ each represent a hydrogen atom, a mercapto group; $R_5$ represents a hydrogen atom, a halogen atom, an alkyl, alkenyl, alkynyl, aryl or alkoxy group, eah of which may be substituted, a nitro group, an amino group, a cyano group, a hydroxycarbonyl group, an alkoxycarbonyl group, an alkylcarbonyl group, a hydroxy group, a mercapto group or a sulfo group; A represents a carbon, nitrogen or oxygen atom, provided that when A represents a carbon atom, $n_2$ is 2; when A represents a nitrogen atom, $n_2$ is 1; and when A represents a oxygen atom, $n_2$ is 0; B represents a nitrogen or carbon atom, provided that when B represents a carbon atom, $n_1$ is 1; and when B represents a nitrogen atom, $n_1$ is 0, $$Rf\text{-}(A)_n\text{-}Y$$

formula [FA]

wherein $R_f$ represents a fluorine-substituted alkyl or aryl group having 3 to 30 carbon atoms; A represents a bivalent linking group having 1 to 12 carbon atoms and a linking group selected from —O—, —COO—, —CO-N—$R_1$, and —$SO_2$, N—$R_1$, in which $R_1$ represents an alkyl group having 1 to 5 carbon atoms; n is 1 or 2; and Y represents —COOM, —$SO_3M$, —$OSO_3M$ or $$-\underset{\underset{O}{\|}}{P}(OM)_2,$$

in which M represents an alkali metal atom, an alkaline earth metal atom or an a quaternary ammonium group, $$(Df)\text{-}(W)_n$$

formula [FK]

wherein $D_f$ a n-valent group containing at least three fluorine atoms and at least three carbon atoms; W represents

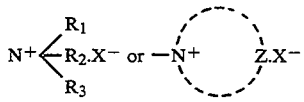

wherein $R_1$ through $R_3$ represents a substituted or unsubstituted alkyl group having 1 to 4 carbon atoms; X represents an halogen atom or a R—$SO_2$—$O^-$ group, in which R represents an alkyl having 1 to 10 carbon atoms or aryl group; Z is an atomic group necessary to form a 5- or 6-membered ring; and n is 1 or 2.

2. The material of claim 1 wherein formula [1] is selected from the group consisting of $HO(CH_2CH_2O)_nH$, [n = 28]

$HO(CH_2CH_2O)_nH$, [n = 35]

$HO(CH_2CH_2O)_nH$, [n = 68]

${}_nC_4H_9O(CH_2CH_2O)_nH$, [n = 20]

$HO(CH(C_2H_5)_2CHO)_nH$, [n = 35 ]

$HO(CH(Cl)CH_2O)_nH$, [n = 22]

$HO(CH(COOH)CH_2O)_nH$, [n = 36]

$HO(CH(SO_3H)CH_2O)_nH$, [n = 36]

${}_nC_{12}H_{25}O(CH_2CH_2O)_nH$, [n = 40]

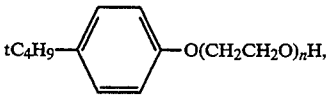

[n = 40]

-continued

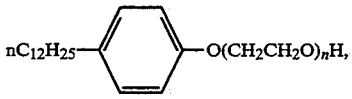

[n = 30]

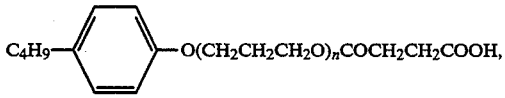

[n = 50]

$HO(CH_2-CH_2-O)_l(CH_2)_m(CH_2-CH_2-O)_nCOCH_2CH_2COOH$,

[l + n = 50, m = 5]

$HO(CH_2-\underset{\underset{CH_2CH_2OH}{|}}{CH}-O)_l(\underset{\underset{CH_3}{|}}{CH}CH_2-O)_m(CH_2\underset{\underset{CH_2CH_2OH}{|}}{CH}O)_nH$ ,

[l + n = 30, m = 35]

$HO(CH_2CH_2)_l(CH_2\underset{\underset{CH_3}{|}}{CH}O)_m(CH_2CH_2O)_nH$,

[l + n = 18, m = 20]

$HO-(CH_2CH_2O)_l-(CH_2\underset{\underset{CHO_2OC_2H_5}{|}}{CH}O)_m-CH_2\underset{\underset{CH_3}{|}}{CH}O-(CH_2\underset{\underset{CH_2OC_2H_5}{|}}{CH}O)_n-(CH_2CH_2O)_o-H$,

[l + o = 20, m + n = 12]

$HO-(CH_2CH_2O)_l-(CH_2\underset{\underset{CHO_2OC_2H_5}{|}}{CH}O)_m-CH_2\underset{\underset{CH_3}{|}}{CH}O-(CH_2\underset{\underset{CH_2OC_2H_5}{|}}{CH}O)_n-(CH_2CH_2O)_o-H$,

[l + o = 17, m + n = 10]

$HO(\underset{\underset{COOH}{|}}{CH}-CH_2O)_l(CH_2\overset{\overset{CH_3}{|}}{C}HO)_m(\underset{\underset{COOH}{|}}{CH}-CH_2O)_nH$,

[l + n = 25, m = 20]

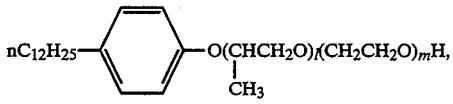

[l = 7, m = 30]

$HOOCCH_2CH_2\overset{\overset{O}{||}}{C}O(CH_2CH_2O)_l(CH_2CH_2CH_2CH_2O)_m(CH_2CH_2O)_n\overset{\overset{O}{||}}{C}CH_2CH_2COOH$,

[l + n = 15, m = 15]

$HOOCCH_2CH_2CO(CH_2CH_2O)_l(\underset{\underset{CH_3}{|}}{CH}CH_2O)_m(CH_2CH_2O)\overset{\overset{O}{||}}{C}CH_2CH_2COOH$,

[l + n = 15, m = 20]

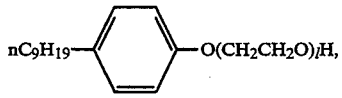

[l = 30]

$HO(CH_2CH_2O)_l(\underset{\underset{(CH_2CH_2O)_nH}{|}}{CH_2CH_2CH_2CH_2O})_m$,

[l + n = 23, m = 21]

$HO(CH_2CH_2O)_l(\underset{\underset{(CH_2CH_2O)_nH}{|}}{CH_2CH_2CH_2CH_2O})_m$,

[l +n = 38, m = 15]

-continued $$HO(CH_2CH_2O)_l(\underset{\underset{CH_2OCH_3}{|}}{C}HCH_2O)_m(CH_2CH_2O)_nH,$$

[l +n = 15, m = 15]

$$HO(CH_2CH_2O)_l(\underset{\underset{CH_2OCH_3}{|}}{C}HCH_2O)_m(CH_2CH_2O)_nH,$$

[l +n = 30, m = 15]

$$_nC_{12}H_{25}O(\underset{\underset{CH_3}{|}}{C}HCH_2O)_l(CH_2CH_2O)_mH,$$

[l = 7, m = 30]

$$HO(CH_2CH_2O)_l(CH_2\overset{\overset{CH_3}{|}}{C}HO)_m(CH_2CH_2O)_nH,$$

[l + n = 25, n = 20]

and $$HO(CH_2CH_2O)_l(CH_2\overset{\overset{CH_3}{|}}{C}HO)_m(CH_2CH_2O)_nH.$$

[l + n = 25, n = 30]

3. The photographic material of claim 2, wherein said compound represented by formula [1] or [2] is contained in an amount of 0.1 mg to 1 g per $m^2$ of the photographic material.

4. The photographic material of claim 1, wherein a ratio of the gelatin to the polymer is within a range of 1:100 to 1:2.

5. The photographic material of claim 1, wherein said polymer particles comprise a polymer selected from the group consisting of a homopolymer of alkyl acrylate, a copolymer of alkyl acrylate and acrylic acid or N-methylolacrylamide, a homopolymer of alkyl methacrylate, a homopolymer of styrene, a copolymer of alkyl methacrylate or styrene and arylic acid, N-methlolacrylamide or glycidolmethacrylate, a homopolymer of butadiene, a copolymer of butadiene and styrene, buthoxymethylacrylamide or acrylic acid, and terpolymer of vinylidene chloride, methyl acrylate and acrylic acid.

6. The photographic material of claim 2, wherein said surfactant represented by formula [FA] or [FK] is contained in an amount of 0.5 to 50 mg per $m^2$ of the photographic material.

* * * * *